US010542852B2

(12) United States Patent
Pickard, III

(10) Patent No.: US 10,542,852 B2
(45) Date of Patent: Jan. 28, 2020

(54) MULTIPLE-PLY SHEETS OF MATERIAL WITH ALTERNATING SECTIONS OF DRY AND POTENTIALLY WET SECTIONS

(71) Applicant: William Marshall Pickard, III, Montgomery, AL (US)

(72) Inventor: William Marshall Pickard, III, Montgomery, AL (US)

( * ) Notice: Subject to any disclaimer, the term of this patent is extended or adjusted under 35 U.S.C. 154(b) by 0 days.

(21) Appl. No.: 14/190,020

(22) Filed: Feb. 25, 2014

(65) Prior Publication Data

US 2014/0173844 A1 Jun. 26, 2014

(51) Int. Cl.

| | |
|---|---|
| ***A47K 10/16*** | (2006.01) |
| ***D21H 27/00*** | (2006.01) |
| ***D21H 27/30*** | (2006.01) |
| *A47K 10/32* | (2006.01) |

(52) U.S. Cl.

CPC ..... *A47K 10/16* (2013.01); *D21H 27/002* (2013.01); *D21H 27/30* (2013.01); *A47K 2010/3266* (2013.01)

(58) Field of Classification Search

CPC .. A61M 35/00; A61M 35/003; A61M 35/006; A47K 10/22; A47K 10/20; A47K 10/16; A47K 2010/3266; A47K 2010/3273; A47K 2010/34; A47K 2010/42; A47K 2010/428; D21H 27/002; D21H 27/30

See application file for complete search history.

(56) References Cited

U.S. PATENT DOCUMENTS

| | | | | |
|---|---|---|---|---|
| 2,209,914 A * | 7/1940 | Wiesendanger, Jr. | .. | A61F 13/84 15/209.1 |
| 3,494,505 A * | 2/1970 | Paul, Jr. | ..... | A45D 34/00 206/820 |
| 4,515,703 A * | 5/1985 | Haq | ..... | C11D 17/049 15/104.93 |
| 4,600,620 A * | 7/1986 | Lloyd | ..... | A47L 13/17 15/104.93 |
| 4,759,652 A * | 7/1988 | Ulrich | ..... | A45D 34/00 15/222 |
| 2003/0084914 A1* | 5/2003 | Simon | ..... | A45D 34/04 132/333 |

* cited by examiner

*Primary Examiner* — David J Walczak
(74) *Attorney, Agent, or Firm* — MU Patents

(57) ABSTRACT

A process of cleansing, sanitizing, polishing, conditioning, disinfecting, and other medical, personal, commercial and industrial purposes by applying continuous multiple-ply sections of material comprised of dry sections of material alternating with wet sections of material in which liquid is encased and is released with application of pressure. The sections can be manufactured into a roll separated by perforation. The sections can also be manufactured into flat sections separated by perforation or laid flat independently or folded one on top of the other. The sections can be configured in an unlimited combination of dry and wet sections, composition of dry materials, composition of liquids, dimensions, connectivity, sizes, thickness and properties that synergistically improve the cleansing process when used in combination together. Habitual waste of materials can be progressively reduced, and ply materials are biodegradable and 100% recyclable providing for environmental preservation.

19 Claims, 9 Drawing Sheets

Figure 1:
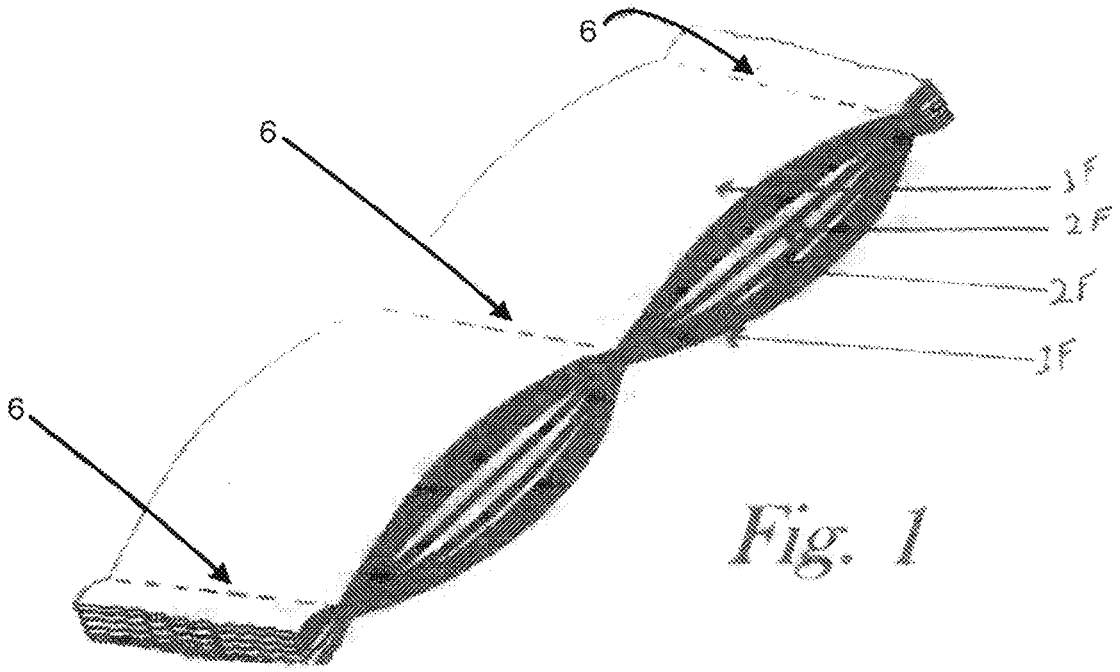

MULTIPLE-PLY SHEETS OF MATERIAL WITH ALTERNATING SECTIONS OF DRY AND POTENTIALLY WET SECTIONS

CROSS REFERENCES TO RELATED APPLICATIONS

This application claims the benefit of provisional patent application No. 61/768,769, confirmation number 4271.

FEDERALLY SPONSORED RESEARCH

None.

SEQUENCE LISTING OR PROGRAM

None.

STATUTORY CLASSES

Processes, Manufactures, and Compositions

BACKGROUND

Prior Art

The following is a tabulation of some prior art that presently appears relevant:

| Pat. No. | Patentee | Pat. No. | Patentee |
|---|---|---|---|
| 5,972,456 | Esquivel, et al. | 7,938,932 | Hermans, et al. |
| 20120016328 | shi; Bo; et al. | RE29,052 | Bucalo, et al. |
| 7,278,187 | Petersen, et al. | 4,927,588 | Schulz, et al. |
| RE40,724 E | Barnholtz, et al. | 5,906,711 | Barnholtz, et al. |
| 5,919,556 | Barnholtz, et al. | 4,100,017 | Flaut, Jr., |
| 7,219,815 | Shannan, et al. | 7,395,986 | Laering, et al. |
| 7,037,020 | Neuendorf, et al. | 5,443,084 | Saleur, et al. |
| 7,004,659 | Goodman, et al. | 6,675,405 | Harm, et |
| 5,375,616 | Chen, et al. | 4,451,943 | Nibler, et al |
| 5,044,556 | Suzuki, et al. | D579,702 | McArdle, et al. |
| D552,902 | Sadeh, et al. | 7,354,598 | Masting, et al. |
| 20090184010 | Palamountain, et al. | 7,749,355 | Knobloch, et al. |
| 20130056489 | Palamountain, et al. | | |

Present means of cleansing includes the problem of combining the use of dry materials for cleansing and wet materials for cleansing including for basic cleaning, sanitizing, polishing, conditioning, disinfecting, medical, private, personal, industrial, commercial and general cleansing purposes. This is accomplished by the process specified herein of providing dry and wet sections of materials that can be used in combination with each other. The means by which those sections are manufactured provide for cleansing that is functionally efficient, cost-effective, convenient, merchantable and environmentally preservational.

Present habits also include wasteful use of materials for cleansing. The present habitual use of materials such as dry tissue paper and paper towel materials results in excessive use of these materials, particularly toilet tissue and paper towel products. Multiple sections of material are pulled and torn from rolls of toilet tissue and paper towel products and thus used in a wasteful manner.

The sections specified herein provide for defective cleansing by use of one section of material at a time, verses multiple sections that are often habitually and wastefully used. A progressive reduction of this habitual waste of materials is provided for herein by the provision of alternating multiple-ply sections of dry material combined with potentially wet sections of material of sufficient composition, tensile strength, dimensions and properties so that one section at a time is sufficient in respective cleansing processes. The present habit of pulling off more than one and often many sections of plies of tissue paper and paper towel products from a roll or flat configuration of plies can be changed to the habit of using one section of such material at a time.

The prior art describes numerous means and concepts for cleansing by utilizing dry and wet materials. However, the prior art has failed to provide a means that is functionally efficient, cost-effective, convenient, merchantable and environmentally preservational.

The primary field of prior art for this invention consists of multiple-layer Material, fabric, fibrous sheets, tissue and variations thereof. The prior art includes multiple-ply products where sections of dry material are of such tensile strength that each section provides for partial cleaning of the intended surface limited by application of dry material. However, no invention was found such as the invention herein disclosed in which there are multiple plies of material which consist of an alternating combination of sections of dry material alternating with sections of potentially wet sections whose surfaces become wet with moderate pressure that releases encased liquid contained in alternating potentially wet sections. This thoroughly improves the process of cleansing and introduces a logistically effective means of changing bad habits of wasting materials.

All components disclosed herein are biodegradable and recyclable. The efficiency provided by the components reduces the material required for respective cleansing purposes. Such factors provide significantly for preservation of the environment by this efficiency and 100% recyclability of ply materials.

The prior art relates to (1) multiple ply tissue and other material, (2) tissue sheets having good strength and bulk, (3) improved design and function of dry tissue paper, (4) packaging two different substrates, (5) toilet paper having a cleansing combination, (6) paper structures having "regions", (7) combined dispenser for toilet paper roll and wet wipes, (8) wet wipes and dry tissue dispenser, (9) paper moistening device and moist toilet paper dispenser, (10) toilet paper misting device, (11) method and apparatus for dispensing solution on toilet paper, (12) devices for moistening toilet paper, (13) wet toilet paper automatic supplier, (14) dispenser for attaching to roll-type toilet-tissue holders and dispensing moist towelettes from a role, (15) dispenser for different substrates, (16) system and dispenser for dispensing wet wipes, (17) method for dispensing wet wipes, (18) flushable hard surface cleaning wet wipe, non-woven wet wiping, (19) prewettable high softness paper product having temporary wet strength, (20) soft filled toilet paper with biased surface properties, (21) a system for dispensing paper in roll form/manufacturing method/roll of paper, and (22) systems and methods for improved bathroom tissue.

The prior art does not identify alternating sections in which multiple-ply sheets and sections of dry material alternate with multiple-ply, potentially wet sheets and sections in which a liquid is encased and is released to moisten the section upon application of pressure. In this invention, the multiple-ply dry sections of material possess tensile strength increased by the inner plies to resist tearing upon application to the surface to be cleansed. The potentially wet multiple-ply sections of material have a liquid encased and enclosed in the center of such sections. When pressure is applied to the sections, the encased liquid is released to moisten the outer plies of material and thus provides for wet cleansing of a surface or other purposes. The increased tensile strength of the outer dry material resists tearing upon release of the liquid encased and enclosed in the center of these potentially wet sections. The increased tensile strength of the inner plies of material enhances the resistance of tearing of the dry sections of material where liquid is not encased in the inner plies.

All sections have sufficient tensile strength to resist tearing upon application of pressure to the palace to be cleansed. Alternating wet sections clean by providing moisture in the form of compositions of liquids. Alternating dry sections clean and absorb the moisture provided by the wet section. There are many applications of this process, manufacture and compositions of material and liquids.

One of the applications of this invention is the process, manufacture, and composition that form rolls of toilet tissue, paper towels and related applications. This invention solves primary issues unresolved by the prior art for the means of cleansing by such common and globally vast applications, primarily by providing efficient, effective and merchantable means for providing dry and wet materials for cleansing and by reducing waste and environmental impact of excessive use of paper and other materials including instances of non-biodegradable ply materials in products described in the prior art.

In the prior art, Esquivel, et al., U.S. Pat. No. 5,972,456, describes a process for forming dry sheets of toilet paper and bathroom tissue products, where a soft and absorbent toilet paper product has multiple plies (six plies identified in the Abstract for this invention). The primary optimal object and advantage of this patented toilet paper product is the fact that each sheet of dry toilet paper is designed with dimensions and thickness that are preferably embossed to form a single unit of multiple ply toilet paper where the product has an overall thickness and tensile strength great enough for the use of the product without folding prior to use. This thickness is identified as preferably 0.04 inches approximately. However, this invention does not propose a process, manufacture and compositions of alternating multi-ply dry tissue sections of material and multi-ply, potentially wet sections of material as disclosed herein.

Hermans, et al., U.S. Pat. No. 7,938,932 also describes tissue sheets having strength and bulk similar and essentially equivalent to the sheets in Esquivel, Shi; Bo, et al., U.S. Patent Application No. 20120016328, describes biodegradable films that can range from liquid permeable film to liquid impermeable film. Such films are utilized for example in disposable diapers, disposable feminine napkins, adult incontinence garments, bandages, and other uses. However, this invention does not propose a method of alternating multi-ply dry tissue sections of material and multi-ply, potentially wet sections of material as disclosed herein.

Bucalo, et al., U.S. Pat. No. RE29,052; describes a toilet paper roll having a cleansing composition. This invention claims a film of cleansing composition at folded web portions of the toilet paper which is frozen to retain each web portion in its folded condition during winding of the web into a roll. However, this invention does not propose a process, manufacture and compositions of alternating multi-ply dry tissue sections of material and multi-ply potentially wet sections of material as disclosed herein.

Petersen, et al., U.S. Pat. No. 7,278,187 describes the process for the manufacture of a multi-layer fabric. The plies can be combined or laminated together using different technologies including carding, spunlacing, meltblowing, spunbonding, or airlaying. However, this invention does not propose a process, manufacture and compositions of alternating multi-ply dry tissue sections of material and multi-ply, potentially wet sections of material as disclosed herein.

Schulz, et al., U.S. Pat. No. 4,927,588, describes a method for multiple ply embossed fibrous sheets. The resulting product of such process enhances softness and absorbance in dry layered tissue. However, this invention does not propose a process, manufacture and compositions of alternating multi-ply dry tissue sections of material and multi-ply, potentially wet sections of material as disclosed herein.

Barnholtz, et al., U.S. Pat. No. RE40,724 E, describes a multiple ply tissue paper structure that has plies with different texture values in three embodiments including a relatively untextured ply disposed between two relatively highly textured plies. Once again, all plies are composed of dry material. (See also previous patents issued to Barnholtz describing multiple ply dry tissue paper. U.S. Pat. Nos. RE40,724, 5,906,711 and 5,919,556). Accordingly, this invention does not propose a process, manufacture and compositions of alternating multi-ply dry tissue sections of material and multi-ply, potentially wet sections of material as disclosed herein.

Flaut, Jr., U.S. Pat. No. 4,100,017, describes sanitary tissue products which are laminates that are formed from two dissimilar paper webs with a web of low density, high bulk process paper united with a web of conventional paper. This produces a product possessing improved absorbency, softness, flexibility and bulk properties. However, this invention does not propose a process, manufacture and compositions of alternating multi-ply dry tissue sections of material and multi-ply, potentially wet sections of material as disclosed herein.

Shannon, et al., U.S. Pat. No. 7,219,815; Laering, et al., U.S. Pat. No. 7,395,986; Neuendorf, et al., U.S. Pat. No. 7,037,020; Saleur, et al.; U.S. Pat. No. 5,443,084; Goodman, et al.; U.S. Pat. No. 7,004,659, Harm, et al., U.S. Pat. No. 6,675,405; Chen, et al., U.S. Pat. No. 5,375,616; Nibler, et al., U.S. Pat. No. 4,451,943; and Suzuki, et al., U.S. Pat. No. 5,044,556; describe the prior art of providing dispensers and other mechanisms by which to moisten toilet paper. These inventions include a dispenser for dispensing two different substrates, a dispenser for readily attaching to a role-type tissue holder and dispensing moist towelettes from a role, a device for moistening toilet paper, a paper moistening device and moist toilet paper dispenser, a method and apparatus for dispensing solution on toilet paper, a toilet misting device, a wet toilet paper automatic supplier, a wetting device for toilet paper, and a water sprayer for wetting toilet paper. These devices are cumbersome, expensive to manufacture, stock, and operate, unmerchantable as shown by lack of merchantability in the present marketplace, and therefore impractical. Moreover, none of these inventions proposes a process, manufacture and compositions of alternating multi-ply dry tissue sections of material and multi-ply, potentially wet sections of material as disclosed herein.

McArdle, et al., U.S. Pat. No. D579,702, and Sadeh, et al.; U.S. Pat. No. D552,902, disclose an ornamental design for a wet wipes and dry tissue dispenser. This obviously requires a significant cost to install the dispenser. Also, unlike Masting below, the wet wipes are entirely exposed and therefore will lose moisture as the device in Masting, and therefore become dry losing the effectiveness of wet material combined with dry material.

Masting, et al., U.S. Pat. No. 7,354,598, describes inventions which are comprised of a co-packaged product which includes a dry paper towel roll and a second substrate which can be a wet wipe container. This invention requires placement of the roll of paper containing wet wipes in the core on a surface rather than the toilet dispenser. This invention also does not provide for impervious protection from evaporation of the liquid on the wet wipes and is therefore unreliable regarding the certain provision of wet and dry wiping and cleansing. As in all previous citations, these inventions do not propose a process, manufacture and compositions of alternating multi-ply dry tissue sections of material and multi-ply potentially and reliably wet sections of material disclosed herein.

Knobloch, et al., U.S. Pat. No. 7,749,355, entitled "Tissue Paper", discloses an invention with specific improvements, but once again the invention only includes dry bathroom tissue material. Similarly, Palamountain, et al., U.S. Patent Nos. 20090184010 and 20130056489, disclose systems and methods for improved bathroom tissue, but again these inventions only include dry materials. These inventions do not propose a process, manufacture and compositions of alternating multi-ply dry tissue sections of material and multi-ply, potentially wet sections of material as disclosed herein.

SUMMARY

In accordance with one embodiment, this invention proposes a process, manufacture and compositions for effective cleansing using a combination of process, manufacture and compositions that produce alternating multi-ply dry sections of material and multi-ply, potentially wet sections of material that are also environmentally preservational.

ADVANTAGES

Accordingly several advantages of one or more aspects are as follows: to provide a convenient, effective, merchantable and environmentally preservational process, manufacture and compositions for cleansing by providing alternating multi-ply dry sections of material and multi-ply, potentially wet sections of material. This provides a comparably inexpensive means for thoroughly effective cleansing by these alternating sections. These sections can be conveniently sized to fit existing fixtures for toilet paper dispensers, paper towel dispensers, and other existing dispensers, as well as customized dispensers for cleansing purposes. Habitual overuse of materials such as toilet tissue and paper towel products is progressively reduced. Other advantages of one or more aspects will be apparent from a consideration of the drawings and ensuing description.

DRAWINGS

Figures

In the drawings, closely related figures have the same number but different alphabetic suffixes.

FIG. 1 is an expanded, cut-away perspective view of a multiple-ply section of material with four plies, where the inner two plies are potentially permeable material that add tensile strength to this section of material. These sections can vary in thickness, tensile strength, composition of dry material in the dry sections and liquids enclosed in the potentially wet sections, number of sections including different dry materials and enclosed liquid materials, and unlimited dimensional measurements and properties.

Figure 2:
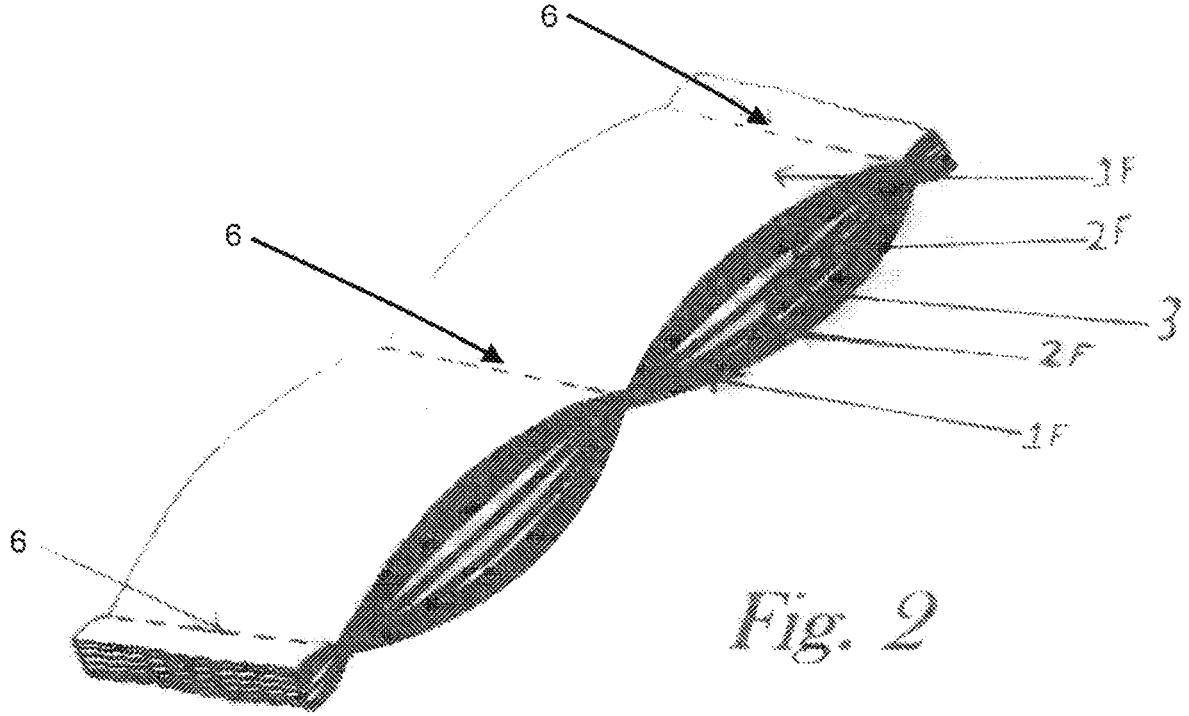

FIG. 2 is an expanded, cut-away perspective view of a multiple-ply section of material with four plies, where the inner two plies are potentially permeable material. The two inner plies encase liquid, and become permeable upon application of pressure. These sections can vary in thickness, tensile strength, composition liquids enclosed in the potentially wet sections, number of sections including different dry materials and enclosed, liquid materials, and unlimited dimensional measurements and properties.

Figure 3:
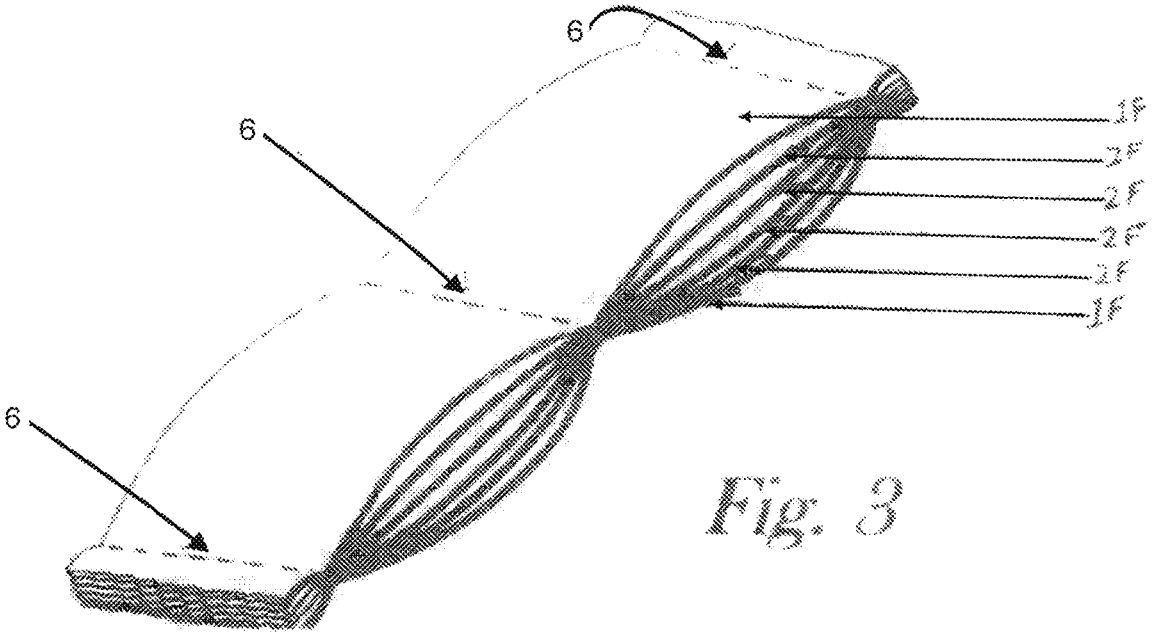

FIG. 3 is an expanded, cut-away perspective view of a multiple-ply section of material with six plies, where the inner two plies or the inner four plies are potentially permeable material that add tensile strength to this section of material. These sections can vary in thickness, tensile strength, composition of dry material in the dry sections and liquids enclosed in the potentially wet sections, number of sections including different dry materials and enclosed liquid materials, and unlimited dimensional measurements and properties.

Figure 4:
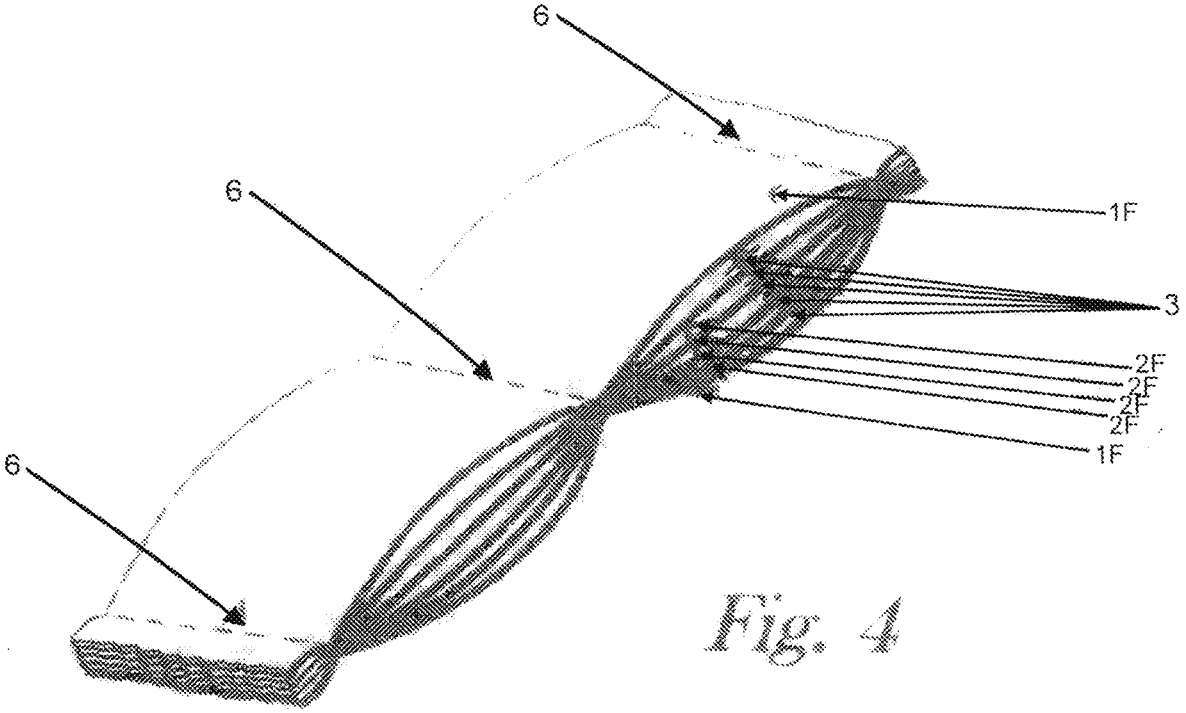

FIG. 4 is an expanded, cut-away perspective view of a multi-ply section of material with six plies, where the inner plies are potentially permeable material. The liquids encased within the inner plies can be the same liquid or different liquids intended to be mixed member for general or specific purposes upon application or released separately onto the two sides of the outer plies of the sections. The two outer plies become moistened when pressure is applied to two or four inner plies which become permeable upon application of pressure releasing the liquids. These sections can vary in thickness, tensile strength, composition of dry material in the dry sections and liquids enclosed in the potentially wet sections, number of sections including different dry materials and enclosed liquid materials, and unlimited dimensional measurements and properties.

Figure 5:
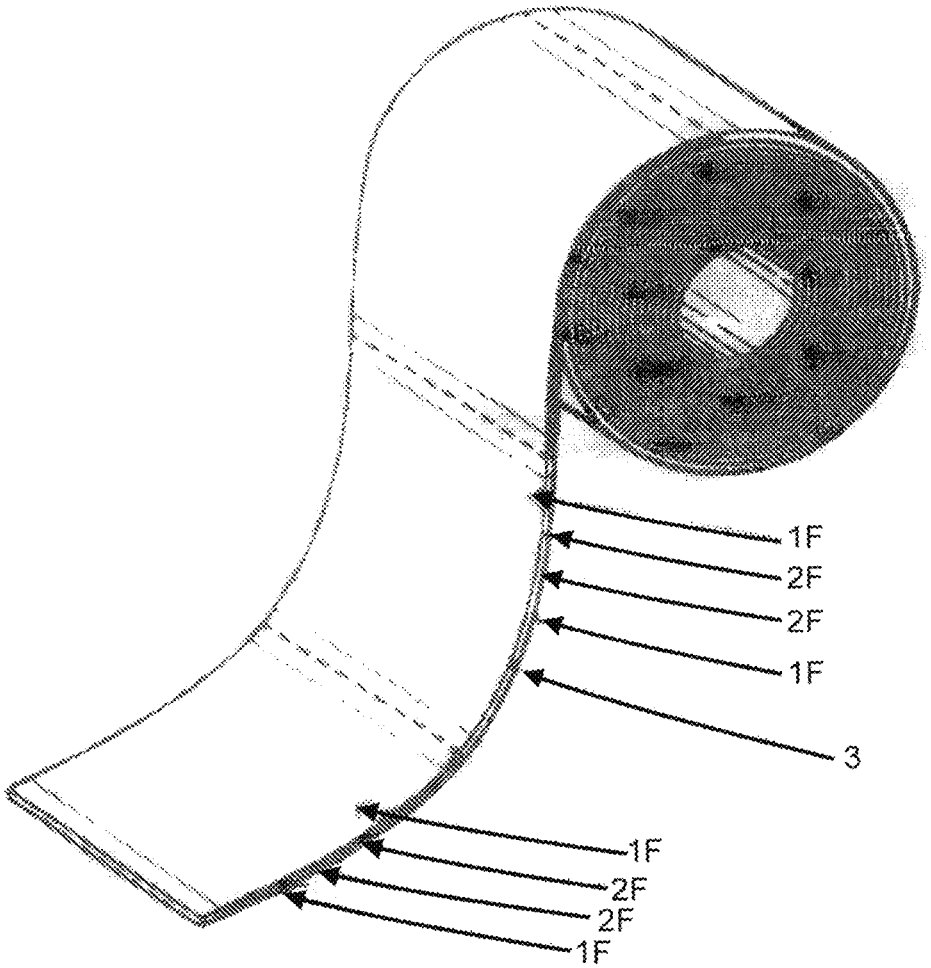

FIG. 5 is a perspective view of a roll of sections of material whose dimensions and properties, including thickness, width and length can be determined without limit, such as those sections of plies described in FIGS. 1, 2, 3, 4, 6, 7, 8, 9, and 10. These sections can vary in thickness, tensile strength, composition of dry material in the dry sections and liquids enclosed in the potentially wet sections, number of sections including different dry materials and enclosed liquid materials, and unlimited dimensional measurements and properties.

Figure 6:
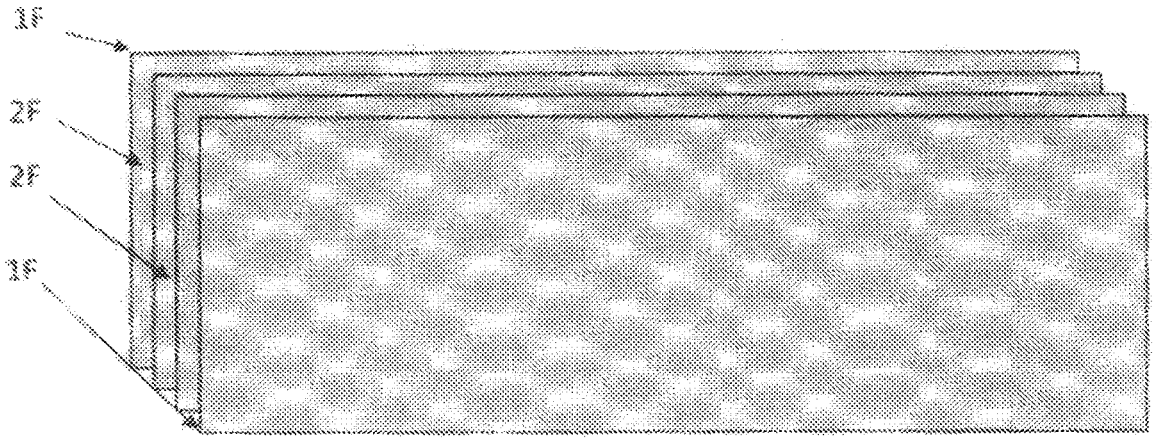
Figure 8:
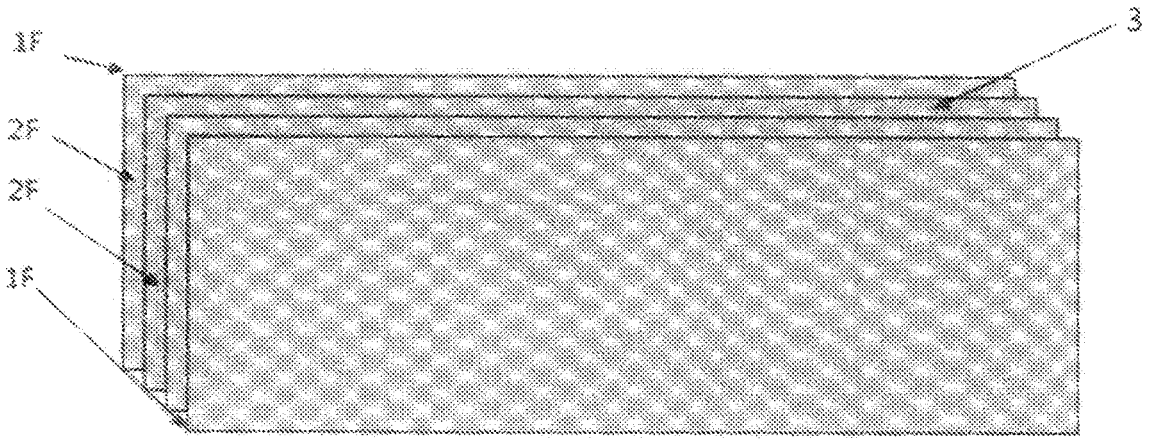

FIG. 6 is an expanded, cut-away perspective view of sections of four plies which do not contain liquid in the inner plies. The inner plies do provide additional tensile strength for the section, and they alternate with potentially wet sections (FIG. 8). These sections can be wound into a roll separated by perforations or laid flat on a continuous sheet connected by perforations or they can be laid flat independently or folded one on top of another in a plurality of combinations and configurations pursuant to specific purposes. This figure illustrates a four-ply combination and configuration. These sections can vary in thickness, tensile strength, composition of dry material in the dry sections and liquids enclosed in the potentially wet sections, number of sections including different dry materials and enclosed liquid materials, and unlimited dimensional measurements and properties.

Figure 7:
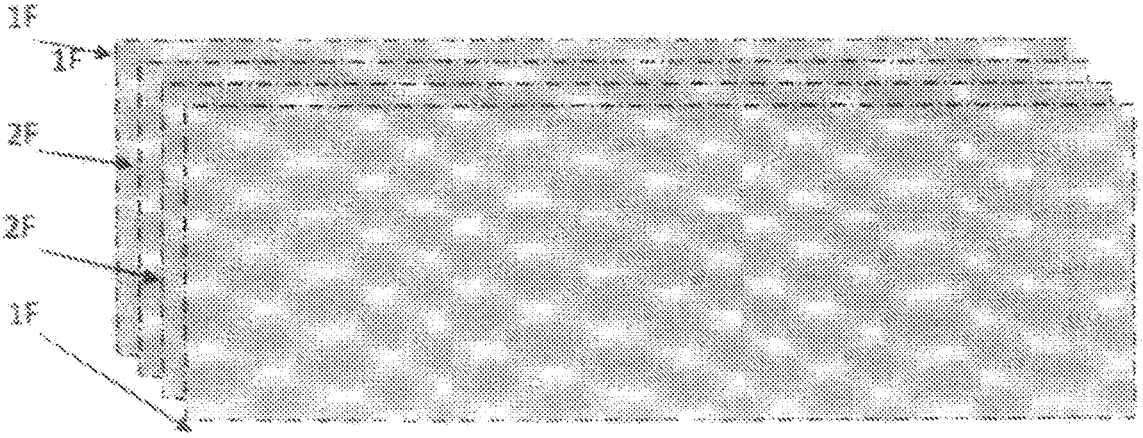
Figure 9:
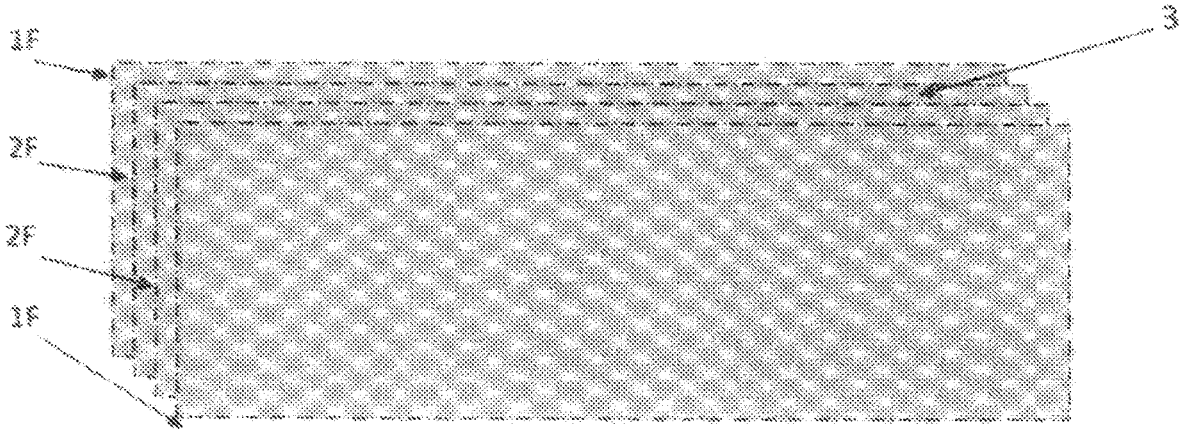

FIG. 7 is an expanded, cut-away perspective view of sections of four plies which do not contain liquid in the inner plies. The inner plies do provide additional tensile strength for the section, and they alternate with potentially wet sections (FIG. 9). These sections can be wound into a roll separated by perforations or can be laid flat as part of a continuous sheet separated by perforations or the sections can be laid flat independently or folded one on top of another in a plurality of combinations and configurations pursuant to specific purposes. These sections can vary in thickness, tensile strength, composition of dry material in the dry sections and liquids enclosed in the potentially wet sections, number of sections including different dry materials and enclosed liquid materials, and unlimited dimensional measurements and properties.

FIG. 8 is an expanded, cut-away perspective view of sections of four plies which do contain a liquid encased in the two inner plies. The plies can be wound into a roll separated by perforations or they can be laid flat as part of a continuous sheet separated by perforations or they can be laid flat independently or folded one on top of others in a plurality of combinations and configurations pursuant to specific purposes alternating with dry sheets (FIG. 6). The inner plies provide tensile strength and moisture to these sections. The multiple ply sections in FIG. 6 alternate with the dry sections in FIG. 8 either on a 1:1 ratio: one dry section (FIG. 6) followed by one potentially wet section (FIG. 8) continuously, or the dry sections (FIG. 6) can alternate in other configurations and combinations with the potentially wet sections (FIG. 8). The liquids can mix together upon application of pressure or can remain unmixed with one liquid released on one side of the outer plies and another liquid unmixed on the other side of the outer plies. These liquids are used in combination with each other. These sections of multiple-ply material can be wound into a roll separated by perforations or can be laid flat as part of a continuous sheet separated by perforations or they can be laid flat independently or folded flat one on top of the other. These sections can vary in thickness, tensile strength, composition of dry material in the dry sections and liquids enclosed in the potentially wet sections, number of sections including different dry materials and enclosed liquid materials, and unlimited dimensional measurements and properties.

FIG. 9 is an expanded, cut-away perspective view of sections of four plies: two outer multiple-ply dry and two inner impermeable plies containing a liquid encased within the two inner plies. These inner plies become permeable upon application of pressure. The multiple ply sections in FIG. 9 alternate with the dry sections in FIG. 7 either on a 1:1 ratio: one dry section (FIG. 7) followed by one potentially wet section (FIG. 9) continuously, or the dry sections (FIG. 7) can alternate in other configurations and combinations with the potentially wet sections (FIG. 9). The liquids can mix together upon application of pressure or can remain unmixed with one liquid released on one side of the outer plies and another liquid unmixed on the other side of the outer plies. These sections can be wound into a roll separated by perforations or they can be laid flat as part of a continuous sheet separated by perforations or the sections can be laid flat independently or folded flat one on top of the other. Those sections can vary in thickness, tensile strength, composition of dry material in the dry sections and liquids enclosed in the potentially wet sections, number of sections including different dry materials and enclosed liquid materials, and unlimited dimensional measurements and properties.

Figure 10:
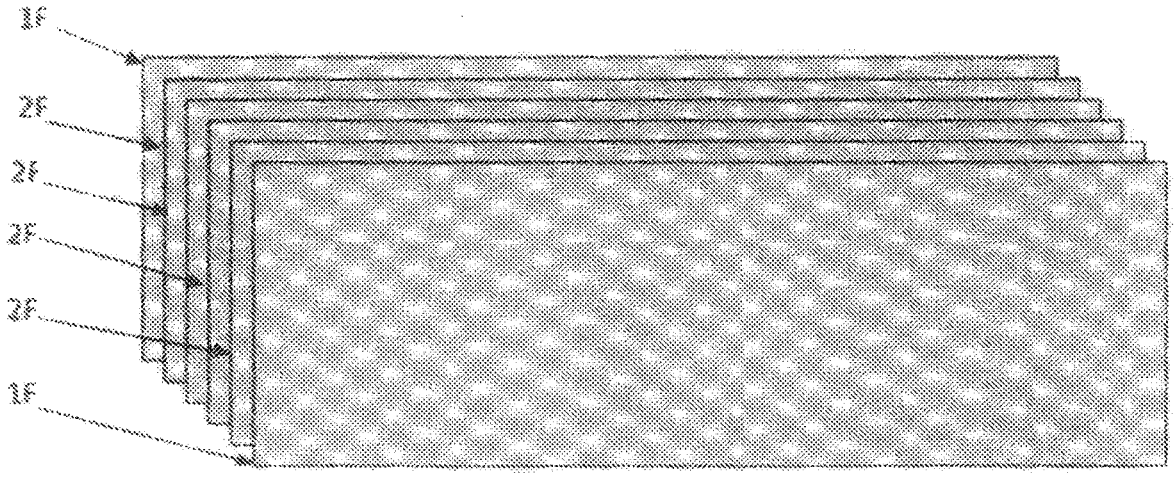

FIG. 10 illustrates multiple ply sections consisting of six plies to illustrate the invention's potential to provide the additional function of releasing more than one type of liquid. Two different liquids can be encased in the four inner plies of impermeable material, which mix together when pressure is applied making the material permeable. FIG. 10 illustrates six plies: two outer plies of absorbent material with four inner plies of thin, impermeable material which can encase and contain liquids. The outer sections are dry, and the four inner plies add significantly to the tensile strength of these sections. These sections of multiple-ply material can be wound into a roll separated by perforations or laid flat and connected on a continuous sheet or they can be laid flat independently or folded flat as independent sheets not connected but laid flat one on top of the other. These sections can vary in thickness, tensile strength, composition of dry material in the dry sections and liquids enclosed in the potentially wet sections, number of sections including different dry materials and enclosed liquid materials, and unlimited dimensional measurements and properties.

Figure 11:
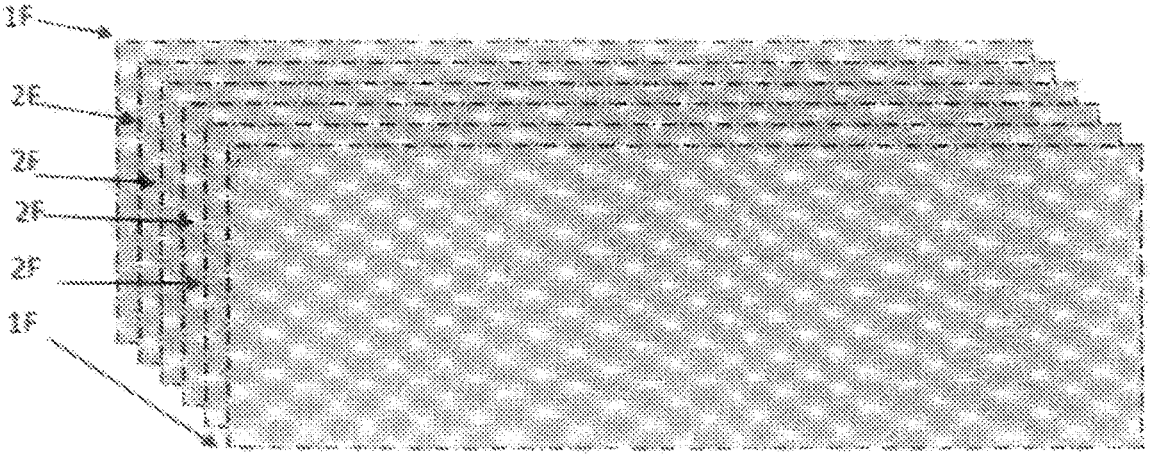

FIG. 11 illustrates multiple ply sections consisting of six plies to illustrate the invention's potential to provide the additional function of releasing more than one type of liquid. The same or different liquids can be encased in the four inner plies of impermeable material. The liquids can mix together by increased pressure or alternating application of both moistened surfaces upon application of pressure or can remain unmixed with one liquid released on one side of the outer plies and another liquid unmixed on the other side of the outer plies. FIG. 11 illustrates six plies which are dry and do not encase or contain any liquid(s). The inner plies serve the function of increasing significantly the tensile strength of these multiple-ply dry sections. These sections can be wound into a roll separated by perforations or laid flat as part of a continuous sheet separated by perforations or the sections can be laid flat independently or folded flat one on top of the other potentially separated by perforations. These sections can vary in thickness, tensile strength, composition of dry material in the dry sections and liquids enclosed in the potentially wet sections, number of sections including different dry materials and enclosed liquid materials, and unlimited dimensional measurements and properties.

Figure 12:
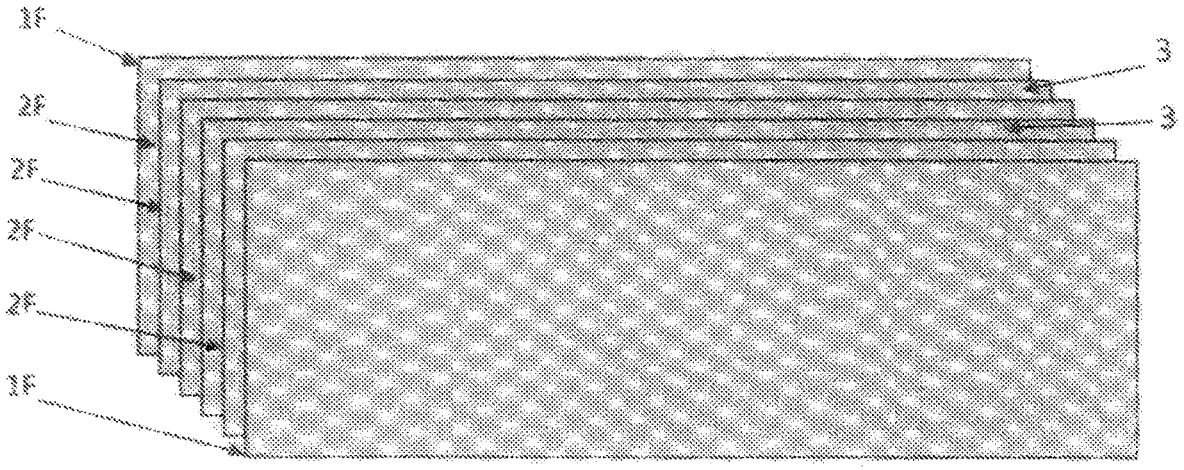

FIG. 12 illustrates the invention's ability to provide two outer layers and a plurality of inner layers containing different liquids which provide optimal applications when mixed together directly before use. The inner plies can contain liquids, either the same liquid or different liquids, which alternate with the dry sections in FIG. 10. The layers in FIG. 12 can contain the same liquid, but by providing a plurality of inner layers, the invention allows for mixing of different liquids encased in the plurality of inner layers which are used most effectively when mixed directly prior to use. The liquids can mix together by increased pressure or alternating application of both moistened surfaces or can remain unmixed with one liquid released on one side of the outer plies and another liquid unmixed on the other side of the outer plies. The plurality of inner plies provides for mixing of a plurality of different liquids. Four inner plies, as in this illustration, can contain two of the same or two different liquids. The provision of six inner plies can contain three liquids. The provision of eight inner plies can contain four liquids, and so forth where addition of two additional inner plies provides for the addition of an additional, separately encased liquid. These liquids are mixed upon application of pressure which causes the impermeable plies to become permeable upon application of pressure. These sections of multiple-ply material can be wound into a roll separated by perforations or can be laid flat independently or folded flat as independent sheets not connected but laid flat one on top of the other. These sections can vary in thickness, tensile strength, composition of dry material in the dry sections and liquids enclosed in the potentially wet sections, number of sections including different dry materials and enclosed liquid materials, and unlimited dimensional measurements and properties.

Figure 13:
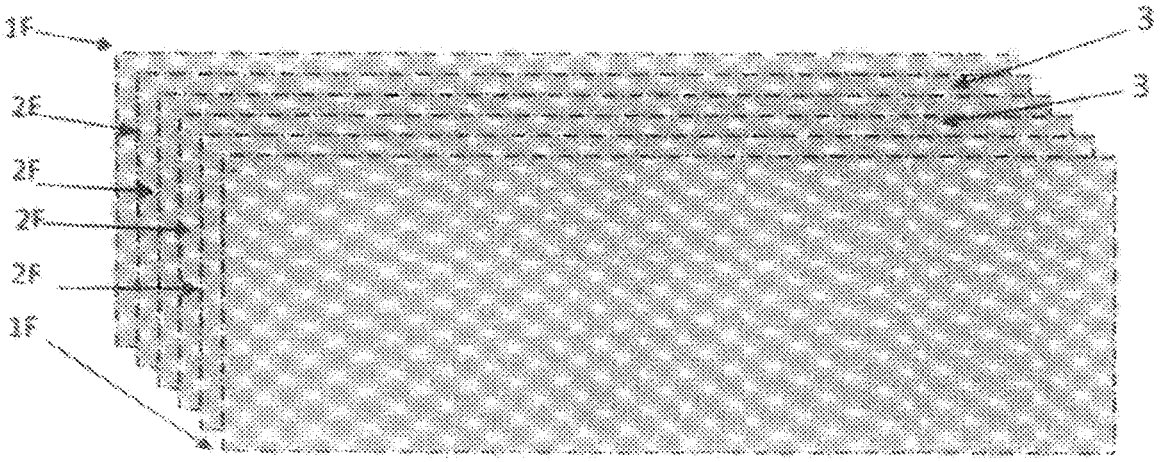

FIG. 13 illustrates the invention's ability to provide two outer layers and a plurality of inner layers containing different liquids which provide optimal applications when mixed together directly before use. The four inner plies contain liquids, either the same liquid or two different liquids, which alternate with the dry sections in FIG. 11. The layers in FIG. 13 can contain the same liquid, but by providing a plurality of inner layers, the invention allows for mixing of different liquids encased in the plurality of inner layers. The liquids can mix together by increased pressure or alternating application of both moistened surfaces or can remain unmixed with one liquid released on one side of the outer plies and another liquid unmixed on the other side of the outer plies. The plurality of inner plies provides for mixing of a plurality of different liquids. Four inner plies, as in this illustration, contain two liquids. The provision of six inner plies contains three liquids. The provision of eight inner plies contains four liquids, and so forth where addition of two additional inner plies provides for the addition of an additional, separately encased liquid. These liquids are mixed upon application of pressure which causes the impermeable plies to become permeable upon application of pressure. The multiple ply sections in FIG. 13 alternate with the dry sections in FIG. 11 either on a 1:1 ratio: one dry section (FIG. 11) followed by one potentially wet section (FIG. 13) continuously, or the dry sections (FIG. 11) can alternate in other configurations and combinations with the potentially wet sections (FIG. 13). These sections can be wound into a roll separated by perforations or can be laid flat on a continuous sheet separated by perforations or the sections can be laid independently or folded flat one on top of the other potentially separated by perforations. These sections can vary in thickness, tensile strength, composition of dry material in the dry sections and liquids enclosed in the potentially wet sections, number of sections including different dry materials and enclosed liquid materials, and unlimited dimensional measurements and properties.

Figure 14:
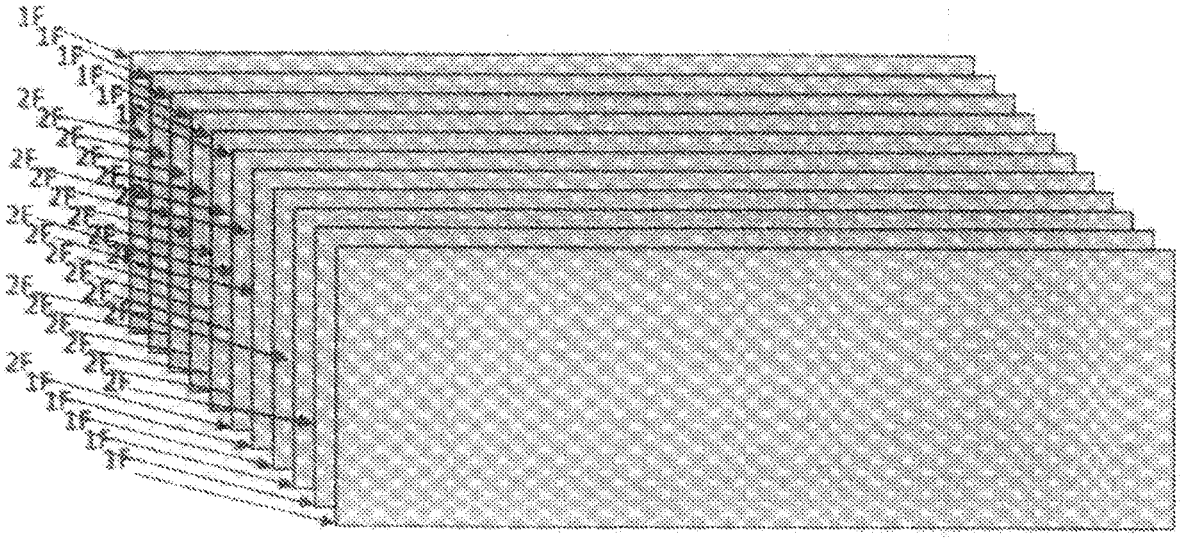

FIG. 14 illustrates the plurality described in FIG. 12 and are dry, multiple-ply layers with two outer layers and an unlimited plurality of inner layers that can encase and contain liquids, whether the same or different. As in FIG. 12, this provides for different liquids to be separately encased within the impermeable inner layers, which can be mixed by increased pressure or alternating application of both moistened surfaces which causes the impermeable layers to become permeable, and results in the mixing of the liquids. This is particularly advantageous where the mixing of liquids directly before use is the effective and most efficacious manner for achieving the cleansing purpose that are improved by the mixing of the liquids. The liquids can mix together upon application of pressure or can remain unmixed with one liquid released on one side of the outer plies and another liquid unmixed on the other side of the outer plies. This outer and inner plies provide for significant increase in tensile strength to be used in combination with the potentially wet multiple ply sections in FIG. 15. These sections can be wound into a roll separated by perforations or they can be laid flat as part of a continuous sheet separated by perforations or the sections can be laid flat independently or folded flat one on top of the other. These sections can vary in thickness, tensile strength, composition of dry material in the dry sections and liquids enclosed in the potentially wet sections, number of sections including different dry materials and enclosed liquid materials, and unlimited dimensional measurements and properties.

Figure 15:
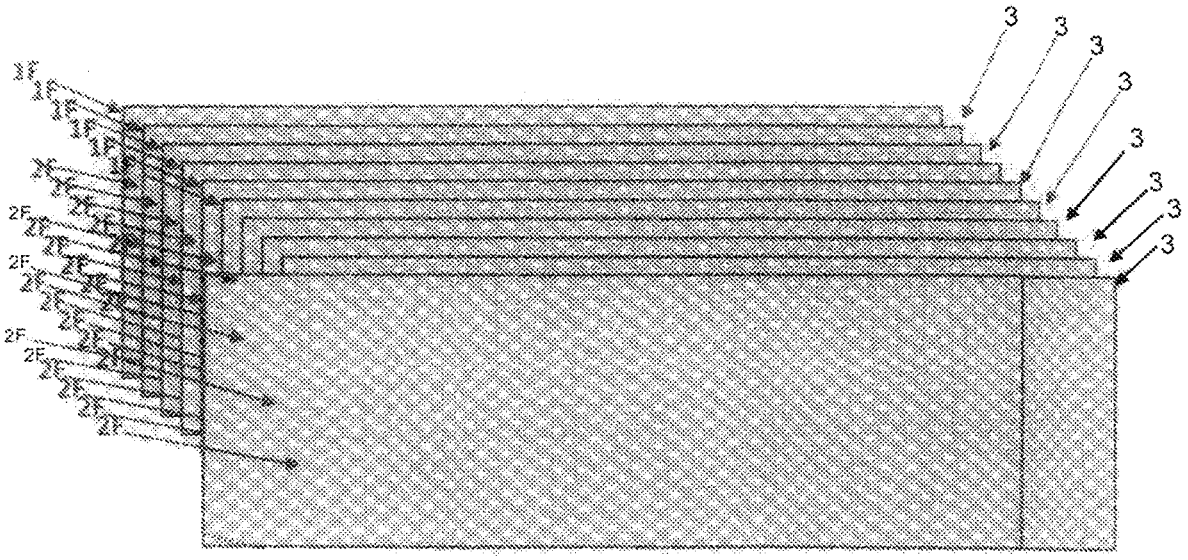

FIG. 15 illustrates the plurality described in FIG. 13 and are multiple-ply layers that contain liquids with two outer layers and an unlimited plurality of inner layers that can encase and contain liquids, whether the same or different. As in FIG. 13, this provides for different liquids to be separately encased within the impermeable inner layers, which can be mixed by increased pressure or alternating application of both moistened surfaces which causes the impermeable layers to become permeable, and results in the mixing of the liquids. The liquids can mix together by increased pressure or alternating application of both moistened surfaces or can remain unmixed with one liquid released on one side of the outer plies and another liquid unmixed on the other side of the outer plies. Again, this is particularly advantageous where the mixing of liquids directly before use is the effective and most efficacious manner for achieving the purpose for the mixing of the liquids. This outer and inner plies provide for significant increase in tensile strength, to be used in combination with the potentially wet multiple ply sections in FIG. 15. The multiple ply sections in FIG. 15 alternate with the dry sections in FIG. 14 either on a 1:1 ratio: one dry section (FIG. 14) followed by one potentially wet section (FIG. 15) continuously, or the dry sections (FIG. 14) can alternate in other configurations and combinations with the potentially wet sections (FIG. 15). These sections can be wound into a roll separated by perforations or can be laid flat as part of a continuous sheet separated by perforations or the sections can be laid independently or folded flat one on top of the other. These sections can vary in thickness, tensile strength, composition of dry material in the dry sections and liquids enclosed in the potentially wet sections, number of sections including different dry materials and enclosed liquid materials, and unlimited dimensional measurements and properties.

DETAILED DESCRIPTION

First Embodiment

FIGS. 1 and 2 illustrate sections of multiple-ply material with four plies. FIG. 1 consists of two outer and two inner plies and does not encase any liquid. FIG. 2 consists also of two outer and two inner plies. The inner plies consist of potentially permeable material that encases and contains a liquid. In both FIGS. 1 and 2, the outer plies are dry tissue and the inner plies are sheets of potentially permeable film. These inner plies increase significantly the tensile strength of the dry sections described in FIG. 1, and makes this section of material resistant to tearing when, for example, it is applied to a dry or particularly a wet surface. A wet surface is more likely to compromise and tear a dry section of material. The inner plies of this impermeable film increases the tensile strength of this dry, multiple-ply section of material. These sections are included in a continuous roll of sections separable by perforation alternating by sections described in FIG. 5 below. The multiple ply sections in FIG. 1 can alternate with the potentially wet sections in FIG. 2 either on a 1:1 ratio: one dry section (FIG. 1) followed by one potentially wet section (FIG. 2) continuously, or the dry sections (FIG. 1) can alternate in other configurations and combinations with the potentially wet sections (FIG. 2). These sections can vary in unlimited dimensional measurements and properties.

In FIG. 6, there are six total plies inner plies where the four inner plies add tensile strength to the two outer plies. In FIG. 7, there are six total plies. The four inner plies referenced in FIG. 7 contain and encase two different or two of the same liquids and are impermeable until pressure is applied which makes the plies permeable which releases the encased liquids to mix and combine to moisten the outer plies of the sections described in FIG. 7. This moistened surface provides for cleaning, sanitizing, conditioning, polishing, degreasing, disinfection, medical, commercial, industrial, general cleansing purposes, and a wide variety of applications and uses referred to and many other functions stated herein.

The multiple ply sections in FIG. 2 can alternate with the potentially wet sections in FIG. 1 either on a 1:1 ratio: one dry section (FIG. 1) followed by one potentially wet section (FIG. 2) continuously, or the dry sections (FIG. 1) can alternate in other configurations and combinations with the potentially wet sections (FIG. 2). These sections can very in unlimited dimensional measurements and properties.

In the invention, there are multiple plies of material which are bonded into sheets or sections in which the plies consist of dry tissue or other material on the outer sides of the sheet or section, with plies of material which encase and contain liquid(s) until pressure is applied releasing the liquid to produce a moist sheet or section. The liquids can mix together upon increased pressure or alternating application of both moistened surfaces upon application of pressure or can remain unmixed with one liquid released on one side of the outer plies and another liquid unmixed on the other side of the outer plies.

These sections can be included in a continuous roll of sections separated by perforations alternating by sections described in FIG. 5. Multiple-ply dry sections alternate in a plurality of ratios, configurations and combinations with multiple-ply wet sections which contain liquid(s). The rolls of sections or the layered flat sections can be devised to contain a plurality of inner plies which are impermeable but potentially permeable, and which contain the same or different liquids. Upon application of pressure, the inner plies become permeable and the liquids mix together. The liquids can mix together upon application of pressure or can remain unmixed with one liquid released on one side of the outer plies and another liquid unmixed on the other side of the outer plies. There are numerous applications where two liquids work more effectively and synergistically when mixed together, but are most effective directly after being mixed together rather than being pre-mixed together. The number of inner plies can be increased to provide for 4, 6, 8, 10, or more inner layers containing combinations of liquids that are more effective, safe and/or stable when separated by plies until pressure is applied releasing the liquids. They are contained separately and a used by application of pressure releasing the liquids to be mixed together and immediately applied for the purposes for the mixed liquids. The outer plies absorb the liquids released by the inner plies and are used in the application of these moistened multiple-ply sections.

FIG. 5 illustrates the process of winding the multiple ply sections into rolls. These rolls can be made with the same essential widths of toilet tissue, paper towels, and other products that are rolled together, so that they are interchangeable with this existing products while providing the advantages of this invention regarding the alternating multiple-ply dry and multiple-ply potentially wet sections.

As stated above, the multiple ply dry sections can alternate with the potentially wet sections either on a 1:1 ratio: one dry section followed by one potentially wet section continuously, or the dry sections can alternate in other configurations and combinations with the potentially wet sections. For certain purposes, this ratio can be changed in infinite combinations of the succession of dry sections and potentially wet sections. These sections can vary in unlimited dimensional measurements and properties.

These multiple-ply, alternating sections of dry and potentially wet sections can be wound into rolls separated by perforations, they can be laid flat as part of a continuous sheet separated by perforations, or they can be independently laid flat or folded as flat sheets, or otherwise configured in an unlimited plurality of combinations and configurations or otherwise made available in a manner most suitable for the purpose for which the sections are used for cleaning, sanitizing, polishing, conditioning, degreasing, disinfection, medical, private, personal, industrial, commercial and other cleansing purposes.

REFERENCE NUMERALS

1F—Ply of dry material.

2F—Ply of thin, impermeable material that can encase a liquid and can become permeable with application of pressure.

3—A liquid encased and contained within the inner plies of two multiple-ply sections

4—Roll of alternating combination(s) of dry and potentially wet sections of material.

5—Configuration of multiple-ply dry section(s) of material and multiple-ply potentially wet section(s) of material laying flat either independently or connected by perforations.

6—Perforations

BACKGROUND OF THE INVENTION

Field of Invention

This invention consists of multiple-ply sheets of dry tissue and/or other material embossed along the edges to form a single section followed by sheets of potentially moistened multiple-ply sheets also embossed to form a single section. These sections can form a continuous succession of sheets which can be: (1) wound into a roll where each section is perforated to separate the alternating sections; (2) folded where each section is perforated and lays flat in alternating sections; (3) laid flat where each section is separate and independent of each other; (4) combined in other ways to provide the most efficacious method of succession and combination of alternating dry and potentially wet sheets. These sections can be laid flat independently or connected by perforation, such as by placement of one on top of the other, in combinations that provide for the best use for a specific task.

Throughout this description of the invention, the level and intensity of pressure required to be applied to multiple ply sections of material that encase a liquid is determined by making the plies sufficiently resistant to becoming permeable by slight pressure but readily permeable by moderate pressure. The pressure required therefore would be sufficient to maintain the liquid encased within the plies while stored and being transported until the application of pressure.

This invention provides a new means for cleaning surfaces by combining alternate use of multiple dry sections of material with multiple ply sections of potentially wet material. The liquids can mix together by increased pressure or alternating application of both moistened surfaces upon application of pressure or can remain unmixed with one liquid released on one side of the outer plies and another liquid unmixed on the other side of the outer plies. The novel result is that one is able to conveniently and thoroughly provide for cleansing with the application of the dry, multiple-ply material and with the application of the multiple-ply potentially wet material to thoroughly and readily provide for cleansing.

The multiple-ply, potentially wet material is composed of a minimum of four plies of material. The two inner plies of material are thin and impermeable, potentially permeable material that is able to contain liquids which are only released by application of pressure. The multiple-ply, dry material is composed of a minimum of two outer plies.

Liquids are contained in the two inner plies for release onto the two outer plies by application of pressure. In alternating sections, liquids are not contained, but the inner plies strengthen the outer plies making the multiple ply section greater in strength and resistant to tearing when placed in contact with a wet or dry surface. The result is that one can have both dry sections of tissue and tissue moistened by pressure releasing liquid contained in the inner plies of the tissue for cleaning, sanitizing, conditioning, polishing, degreasing, disinfection, medical, commercial industrial, general cleansing, and a wide variety of applications and uses.

The sections of multiple ply dry tissue are embossed along the edges to provide increased tensile strength when applied to a surface, particularly a moistened surface. The sheets of multiple ply, potentially wet tissue are also embossed along the edges to provide for a liquid substance to be encased and enclosed within in the sheet which is contained by a semi-permeable layer of material that allows for the release of the liquid only upon application of pressure. The liquid is released when pressure is applied to provide a moistened tissue surface to enhance the sheets' effectiveness when applied to surfaces.

When laid flat or wound into a roll with perforated sections or otherwise configured, the sections of multiple-ply dry sheets and multiple-ply, potentially wet sections can alternate to provide the optimal sequence of dry and potentially wet sections depending on the particular use and application for the sections. The sections can be adapted to any sequence, combination, or means of dispensation according to the purpose that it is used for.

Another example is that the length of sheets can form a roll where the dry sheets alternate with potentially wet sheets that are wound lengthwise to term a roll on a hollow core separated by perforations, similar to a roll of toilet paper, except that the dimensions of each multiple-ply section can be lengthened to provide a large enough surface to cover the peri-anal area. Most toilet tissue sections are not sufficient in length for this purpose. Such rolls can also be consistent with dimensions of existing rolls of paper towels and similar wiping and/or cleansing materials.

The same general process can be applied for other products in respective dimensions and tensile strengths to provide for cleansing or other purposes by the application of (1) alternating sections(s) of multiple-ply dry tissue or material and (2) section(s) of multiple-ply potentially wet tissue or material in which a quantity of liquid is encased within the center of the plies until released to moisten this section of tissue by exertion of pressure.

Objects and Advantages

Accordingly, the basic objects and advantages of the invention are:

(1) The primary object of this invention is to provide for effective and conveniently practicable cleansing and other applications by providing for alternating sections of dry material and sections of potentially wet material.

(2) The primary advantage of this invention is the provision of the availability of alternating sources of dry material and sources of moistened material for cleansing and other purposes in a convenient, economical, environmentally biodegradable and recyclable, effective and thorough manner. Multiple-ply sections of dry tissue or other material are provided alternatively with sections of potentially wet sections of tissue or other material in which a liquid is encased and is released when pressure is exerted.

(3) Another primary advantage of this invention is the ability to provide stable liquids in sections of material in which liquids are encased that meet specific purposes including stable liquids with therapeutic and/or industrial cleansing properties such as antiseptic, anti-viral, anti-bacterial, disinfecting, medical, moisturizing, detergent, degreasing, and other purposes, as well as for cleaning, sanitizing, polishing, conditioning, disinfection, medical, private, personal, industrial, commercial and general cleansing purposes.

(4) In the case of bathroom tissue and paper towels, this invention provides for alternating sheets of dry and moistened material that are readily and conveniently available for the most effective cleansing of skin and other surfaces. No special alteration or installation of any apparatus, such as for moistening or misting or separate dispensing of wet material is required.

(5) In the case of bathroom tissue, the length of each section can be increased from the average length of bathroom tissue that is currently available in the marketplace, which is approximately 10 to 11 centimeters, to an increased length, for example: 14-16 centimeters, that adequately covers the perianal area for the average person, and thus allows for each section of this application of the invention to cleanse the peri-anal area without the habitual and wasteful tearing of multiple sheets to fold over to cover this area which is required with current lengths of bathroom tissue sold in the marketplace.

(6) All liquids in the potentially wet sections are stable and encased, by which the problems of evaporation and degradation are addressed and effectively solved.

(7) Such hygiene from bathroom tissue is also more efficient and economical by the increased tensile strength of the sheets of material which avoids the waste of having to use multiple sheets of tissue folded together. The tensile strength of the multiple ply sheets of dry and moistened tissue provided by this invention allows for use of one sheet at a time versus multiple sheets folded together which are required by most tissue products. The wetting of average toilet paper compromises the tensile strength of such paper to a significantly greater degree than if the paper remained dry, and requires even more multiple sections of toilet paper folded over, which is wasteful, inconvenient, and often results in direct contact with the contaminated surface which is being cleansed.

(8) Also, a liquid to moisten toilet paper is often unavailable in public and private locations without a source of sanitary liquid to wet the dry tissue paper. In public establishments where cleansing agents are not available, and especially where running water is unavailable, this can be a source of major hygiene compromise. This invention solves these problems by providing a convenient and economical means of surfaces by application of dry multiple-ply sheets alternating with potentially wet multiple-ply sheets.

(9) The adaptability of the invention is also a major advantage. In this invention, dry and moistened cleansing can be adapted for situations which would benefit from such a process. For example, the process of utilizing such alternating dry and potentially wet plies can be interchangeable with current processes in respective sizes and dimensions for such other processes and related products.

(10) This process of providing for alternating multiple ply dry and multiple-ply, potentially wet tissue and other materials are cost effective to manufacture. They also require no mechanism or other adaptation whatsoever as required in other patents identified and issued in this area, since the products and rolls of these materials can be manufactured to be of adequately equivalent dimensions, thickness, and inner core to be placed or installed wherever dry toilet, paper towel, or other products that are now used.

(11) This invention solves the major problem of providing for effective cleansing including personal hygiene by a convenient combination of the use of dry and moistened materials. It can be used in any situation where dry and moistened cleansing is to be placed, such as in bathroom, kitchen, work, aircraft, aquatic and other transportation lavatories and the facilities, hospitals and clinics, and most areas. This process can further be applied for multiple other purposes.

(12) This invention is particularly advantageous for use in public bathrooms where dry and moistened cleansing cannot otherwise be effectively and conveniently provided.

(13) This invention can provide for effective cleansing utilizing dry and moist materials in numerous other situations such as restaurants where dry and moistened cleansing of the hands at meals can be effectively and conveniently provided for by adaptation of the invention in the dimensions of a paper napkin with dry and potentially wet sections.

(14) Another primary advantage of this invention is that the rolls of multiple ply tissue are economical by providing for use of fewer sheets of tissue. Also, all of the materials utilized for this invention can be derived from biodegradable and recyclable materials.

(15) This method of provides for alternating dry and moistened cleansing that can be applied in numerous other instances in which there is a need or advantage to provide for dry and moistened cleansing.

(16) The adaptability of the invention for specific purposes also provides an additional advantage. The multiple ply sections of dry material can alternate with multiple ply, potentially wet material that has one liquid encased within the inner plies in the instance of a four-ply section of material where only one liquid is effective. However, additional plies can be configured to contain more that one encased liquid, including combinations of inner plies which contain different liquids which can work together when released by application of pressure, where the liquids then combine to provide a specific purpose. This invention is adaptable to provide as many plies containing as many liquids as a particular use may call for, followed by sections with plies of dry material in combination with the sections of potentially wet material.

OPERATION

The primary configurations for the invention are rolls of sections of alternating multiple-ply dry sections of material and multiple-ply sections of potentially wet material, and flat sections of alternating multiple-ply dry sections of material and multiple-ply sections of potentially wet material either independently laid one on top of the other or formed into a continuous sheet separated by perforations where the sections lie flat connected by perforation.

One uses the multiple-ply dry sections alternating with the multiple-ply wet sections in which liquids are encased by the inner plies for various purposes such as cleaning, sanitizing, conditioning, polishing, degreasing, disinfection, medical, commercial, industrial, general cleansing purposes, and a wide variety of applications and uses. Pressure is applied to the multiple-ply potentially wet sections, which causes the impermeable inner plies to become permeable and release the liquid(s) encased in the inner plies. These liquids provide an essential role in the purpose for the use of the invention by providing for wet applications. Liquids contained in multiple ply configurations that allow for more than one liquid can be mixed together or designed to remain independently on the two outer surfaces. The liquids can mix together upon increased application of pressure causing the liquids to mix or the liquids can remain unmixed with one liquid released on one side of the outer plies and another liquid unmixed on the other side of the outer plies. One then uses the multiple-ply dry sections to absorb the moisture for the various purposes such as cleaning, sanitizing, conditioning, polishing, degreasing, disinfection, medical, commercial, industrial, general cleansing purposes, and a wide variety of applications and uses further referred to herein. One can begin by using a multiple-ply dry section to begin the cleansing process or one can begin by using a potentially wet section in which a liquid is encased and is released upon application of pressure when applied to the surface being cleaning, sanitizing, conditioning, polishing, degreasing, disinfection, medical, commercial, industrial general cleansing purposes, and a wide variety of applications and uses further referred to herein. The inner ply material can be a thin film of plastic or similar material that is impermeable when not subjected to moderate pressure but which can become permeable when moderate pressure is applied to this film, such as by a person's fingers. The invention therefore operates to achieve the purposes stated above by application of the multiple-ply dry sections alternating with the multiple-ply potentially wet sections where the encased liquids are released by pressure.

CONCLUSION, RAMIFICATIONS AND SCOPE

Accordingly, the reader will see that the process of providing multiple ply sections with alternating sections of dry and potentially wet materials provides a solution to the problem of devising a means of effective cleansing. The manufacture of multiple ply sections provides for this alternating application of dry material and wet material to the process of cleansing. The composition of the dry material and liquids can allow for an unlimited multiplicity of means for cleansing purposes. Habitual waste of materials can be progressively reduced. Reduction in this waste together with the 100% biodegradable and recyclable ply materials provides for environmental preservation.

I claim:

1. A multilayer material comprising:

a. two or more liquid-containing layers; and b. at least one absorbent layer in communication with at least one of the two or more liquid-containing layers, wherein each of the two or more liquid-containing layers contain a liquid, wherein the liquid remains separated, wherein the liquid contained within each of the two or more liquid-containing layers remain separated until they are released via pressure, and wherein the at least one absorbent layer becomes wet when the one or more liquids are released.

2. The multilayer material of claim 1, wherein the two or more liquid-containing layers and the at least one absorbent layer are permeable.

3. The multilayer material of claim 2, wherein the at least one absorbent layer comprises one or more dry materials, and wherein the one or more dry materials are configured to mix with the one or more liquids.

4. The multilayer material of claim 3, wherein the liquid and the one or more dry materials are hygienic.

5. The multilayer material of claim 3, wherein an outermost layer is a absorbent layer.

6. The multilayer material of claim 1, wherein the two or more liquid-containing layers and the at least one absorbent layer comprise a plurality of perforations.

7. The multilayer material of claim 1, wherein each of the two or more liquid-containing layers contain a different liquid, wherein each of the different liquids mix together when pressure is applied, and wherein the mixture of the different liquids permeates the at least one absorbent layer.

8. The multilayer material of claim 7, wherein one liquid is released from one side of the multilayer material, and a separate liquid is released from another side of the multilayer material.

9. A multilayer material comprising:

a. two or more liquid-containing layers; and b. at least one absorbent layer in communication with at least one of the two or more liquid-containing layers, wherein each of the two or more liquid-containing layers encase different liquid, wherein the different liquid remains separated, until they are released via pressure, and wherein the at least one absorbent layer becomes wet when the one or more liquids are released.

10. The multilayer material of claim 9, wherein the two or more liquid-containing layers and the at least one absorbent layer are permeable.

11. The multilayer material of claim 10, wherein the at least one absorbent layer comprises one or more dry materials, and wherein the one or more dry materials are configured to mix with the one or more liquids.

12. The multilayer material of claim 11, wherein the one or more liquids and the one or more dry materials are hygienic.

13. The multilayer material of claim 11, wherein an outermost layer is a absorbent layer.

14. The multilayer material of claim 9, wherein the two or more liquid-containing layers and the at least one absorbent layer comprise a plurality of perforations.

15. The multilayer material of claim 9, wherein each of the two or more liquid-containing layers contain a different liquid, wherein each of the different liquids mix together when pressure is applied, and wherein the mixture of the different liquids permeates the at least one absorbent layer.

16. The multilayer material of claim 15, wherein one liquid is released from one side of the multilayer material, and a separate liquid is released from another side of the multilayer material.

17. A multilayer material comprising:

a first liquid-containing layer, wherein the first liquid-containing layer contains a first liquid within the first liquid-containing layer, the first liquid-containing layer having a first surface and a second surface;

a first absorbent layer having a first surface and a second surface, the first surface of the first absorbent layer in communication with the first surface of the first liquid-containing layer, wherein the first liquid remains separate from the first absorbent layer and wherein the first liquid wets the first absorbent layer responsive to pressure applied to the first liquid-containing layer;

a second liquid-containing layer, wherein the second liquid-containing layer contains a second liquid within the second liquid-containing layer, the second liquid-containing layer having a first surface and a second surface, the first surface of the second liquid-containing layer in communication with the second surface of the absorbent layer and wherein the second liquid remains separate from the first absorbent layer and wherein the second liquid wets the first absorbent layer responsive to pressure applied to the second liquid-containing layer; and a second absorbent layer having a first surface and a second surface, the first surface of the second absorbent layer in communication with the second surface of the second liquid-containing layer, wherein the second liquid remains separate from the second absorbent layer and wherein the second liquid wets the second absorbent layer responsive to pressure applied to the second liquid-containing layer.

18. The multilayer material of claim 17, wherein the first liquid is a first type of liquid and second liquid is a second type of liquid and the first type of liquid is distinct from the second type of liquid.

19. The multilayer material of claim 18, wherein the first and second absorbent layers and the first and second liquid-containing layers are permeable.

* * * * *